US011178905B2

(12) United States Patent
Karim

(10) Patent No.: US 11,178,905 B2
(45) Date of Patent: Nov. 23, 2021

(54) SYSTEM FOR ROLLING AND FILLING CIGARETTES WITH SMOKABLE MATERIAL

(71) Applicant: CMG LTD., Santa Venera, MT (US)

(72) Inventor: Sayed Amir Karim, Sliema (MT)

( * ) Notice: Subject to any disclaimer, the term of this patent is extended or adjusted under 35 U.S.C. 154(b) by 0 days.

(21) Appl. No.: 16/852,095

(22) Filed: Apr. 17, 2020

(65) Prior Publication Data

US 2020/0329756 A1 Oct. 22, 2020

Related U.S. Application Data

(60) Provisional application No. 62/835,072, filed on Apr. 17, 2019, provisional application No. 62/980,716, filed on Feb. 24, 2020.

(51) Int. Cl.

| | |
|---|---|
| ***A24C 5/44*** | (2006.01) |
| ***A24C 5/42*** | (2006.01) |
| *A24C 5/47* | (2006.01) |

(52) U.S. Cl.

CPC ..... *A24C 5/44* (2013.01); *A24C 5/42* (2013.01); *A24C 5/474* (2013.01)

(58) Field of Classification Search

CPC .... A24C 5/44; A24C 5/46; A24C 5/42; A24C 5/474

USPC ..... 131/36, 38, 57, 58, 59, 73, 81.1, 70, 28

See application file for complete search history.

(56) References Cited

U.S. PATENT DOCUMENTS

| | | | | |
|---|---|---|---|---|
| 4,158,989 | A * | 6/1979 | Barr | B31C 7/02 493/108 |
| 7,905,235 | B2 * | 3/2011 | Patel | A24C 5/02 131/57 |
| 2017/0119043 | A1 * | 5/2017 | Swanson | A24C 5/42 |
| 2017/0238601 | A1 * | 8/2017 | Makboul | A24D 3/0229 |
| 2018/0213838 | A1 * | 8/2018 | Richmond | A24B 7/04 |
| 2019/0059440 | A1 * | 2/2019 | Yang | A24C 5/44 |
| 2019/0297936 | A1 * | 10/2019 | Kang | A24C 5/46 |
| 2020/0170293 | A1 * | 6/2020 | Kesselman | A24C 5/002 |

FOREIGN PATENT DOCUMENTS

| | | | | |
|---|---|---|---|---|
| FR | 461791 | A | 1/1914 | |
| FR | 2558042 | A1 | 7/1985 | |
| WO | 2016125162 | A1 | 8/2016 | |
| WO | WO-2016125162 | A1 * | 8/2016 | A24C 5/10 |

* cited by examiner

*Primary Examiner* — Michael H. Wilson
(74) *Attorney, Agent, or Firm* — Hall Estill Law Firm

(57) ABSTRACT

Apparatus and method for forming a tube of planar material suitable for use as a casing for a cigarette. In some embodiments, a cone is disposed within an interior chamber of a housing, the cone having an annular base and a tapered portion extending from the annular base. The tapered portion has a frusto-conically shaped outer surface. A body portion is attachable to the annular base of the cone to induce rotation of the cone with respect to the housing. Rotation of the cone enables wrapping of a planar material, such as a rolling paper or a blunt sheet, about the cone to form a hollow tube having a frusto-conical shape. In further embodiments, a grinder assembly presses organic smokable material through a screen to direct the material through the body portion and into the tube. Filter media can be incorporated into the tube as desired.

21 Claims, 11 Drawing Sheets

SYSTEM FOR ROLLING AND FILLING CIGARETTES WITH SMOKABLE MATERIAL

RELATED APPLICATIONS

The present application makes a claim of domestic priority to U.S. Provisional Patent Application No. 62/835,072 filed Apr. 17, 2019 and U.S. Provisional Patent Application No. 62/980,716 filed Feb. 24, 2020. The contents of these provisional applications are hereby incorporated by reference.

BACKGROUND

As used herein, the term "cigarette" refers to any number of different types of smokable products in which a planar material is rolled into a tube having an elongated, hollow shape. The tube is filled or otherwise packed with a substance having beneficial effects such as cannabis, tobacco, herbs, or some other suitable material. The tube can be cylindrical or tapered.

One end of the cigarette is ignited, which initiates a slow combustion of the product and the tube material. A user inhales the smoke generated by the combustion of the product through the other end of the cigarette. A cigarette provides an efficient mechanism to deliver pharmaceutical constituents of the filler material via an aerosol that is breathed in and absorbed through the lungs of the user.

SUMMARY

Various embodiments of the present disclosure are generally directed to an apparatus and method for rolling a planar material into a tube suitable for use as a casing for a cigarette, as well as for filling the tube with smokable material to provide a fully formed cigarette.

In some embodiments, a cone is disposed within an interior chamber of a housing. The cone has an annular base and a tapered portion extending from the annular base. The tapered portion has a frusto-conically shaped outer surface. A body portion is attachable to the annular base of the cone to induce rotation of the cone with respect to the housing. Rotation of the cone enables wrapping of a planar material, such as a rolling paper or a blunt sheet, about the cone to form a hollow tube having a frusto-conical shape. In further embodiments, a grinder assembly presses organic smokable material through a screen to direct the material through the body portion and into the tube. A filter mechanism can be incorporated into the tube as desired.

Other features and advantages of various embodiments can be understood from the following detailed description in conjunction with a review of the accompanying drawings.

DETAILED DESCRIPTION

Figure 1:
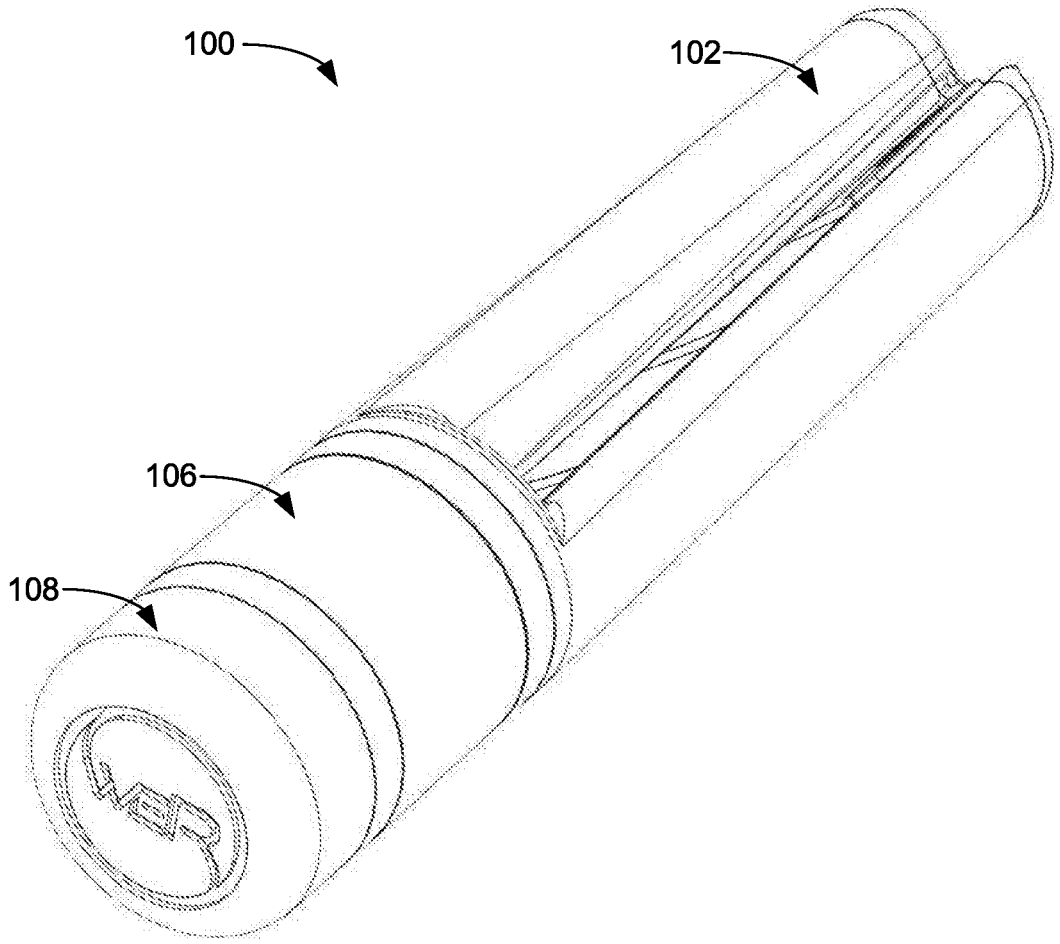
FIG. 1 is an isometric depiction of a cigarette roller and filler system constructed and operated in accordance with some embodiments of the present disclosure.

Some embodiments of the present disclosure are generally directed to rolling a planar material into a tube suitable for use as a casing for a cigarette. Further embodiments are directed to filling the tube with smokable material such as cannabis, tobacco, herbs, or other suitable products to generate a fully formed cigarette.

As explained below, some embodiments provide a portable cigarette roller and filler system. The system includes a case, also referred to as a housing. The case has opposing proximal and distal ends.

A cone having a frusto-conical tapered shape is adapted to be inserted into a central chamber within the case through an opening disposed at the proximal end of the case. The cone, also sometimes referred to as a pin, has a larger end and a smaller end. A body portion, which may take the form of a funnel body, has a substantially cylindrical shape lockingly engages the larger end of the cone at the proximal end of the case.

An elongated slot extends substantially along an entire length of the case. The slot is adapted to enable a user to introduce a strip of planar material, such as a rolling paper or blunt sheet, into the central chamber adjacent one side of the cone. The user rotates the funnel body with respect to the case to cause the planar material to wrap around the cone, thereby forming a frusto-conically shaped, tapered tube of the planar material.

Once formed, the funnel body is removed from the proximal end of the case, and the cone is removed from the interior of the tube. At this point, the user may remove the fully formed, empty tube from the case. The tapered tube will have a selected amount of structural rigidity, allowing the tube to be utilized separately for any number of conceivable purposes. These can include applications such as, but not necessarily limited to, forming a cigarette, a funnel, a cotton candy holder, an ear wax candle, a plant stem holder, etc.

However, it is contemplated that the tube will be retained within the central chamber of the case after the funnel body and the cone have been removed. This is to enable the system to fill the tube with smokeable product to form a cigarette. In such case, the funnel body is reattached by the user to the proximal end of the case, allowing a funnel projection of the funnel body to partially extend into the larger end of the tube.

Smokable product, such as an appropriate quantity of cannabis, tobacco, herbs or other material, is introduced into a grinder assembly of the system. The grinder assembly is located adjacent an opposing end of the funnel body opposite the case.

The grinder assembly includes a grinder press adapted to press, via user pressure, the product against a fine mesh screen extending across the opposing end of the funnel body. The pressure applied by the user crushes the product, allowing particulates of the product to pass through the screen, down through the funnel body, and into the previously formed tube in the case.

Once the tube has been filled with a sufficient amount of product, the user detaches the funnel body from the case. A lever mechanism mounted at a distal end of the case can be activated to slidingly advance the cigarette partially out of the case, allowing a user to grasp the larger end of the cigarette to pull it from the case. The fully formed cigarette can now be ignited and smoked by the user. The user lights the larger end of the cigarette, and inhales the generated smoke through the smaller end of the cigarette.

Further embodiments include a number of additional features that can be incorporated into the system as desired. In some examples, a product storage area is provisioned to enable the product to be stored within an interior storage chamber of the grinder assembly prior to use. A rolling material bracket can be inserted through an aperture in the proximal end of the case to accommodate storage of a quantity of papers or blunt sheets within an interior storage area of the case that extends along a first side of the central chamber of the case. A cigarette cavity extends upwardly from the distal end of the case along an opposing, second side of the central chamber of the case, and can be used to store a newly formed and/or partially smoked (extinguished) cigarette. A hinged cover can be used to enclose the cigarette cavity. Further chambers can be used for storage of filters or other user supplies, the placement of electronic elements, etc.

In some configurations, a series of spaced apart magnets are provided at various mechanical junctions to interconnect various elements of the system. This includes the junction between the cone and the funnel body, the junction between the funnel body and the proximal end of the case, and the junction between the bottom of the grinder press and the screen. Locking features can be used to rotationally secure the cone to the funnel body, so that the cone is rotated by user rotation of the funnel body.

The spaced apart magnets can further be used to allow a ratcheting action as the user rotates the funnel body with respect to the case during the rolling operation to form the tapered tube. The magnets permit controlled rotation of the funnel body and the cone by the user in discrete increments while providing a retention force to maintain the funnel body coupled to the case.

Still further alternative embodiments include the application of gripping material, such as rubber or silicone, to an outside surface of the cone. The gripping material enhances gripping contact between the rolling material and the cone during the rolling operation. Other alternatives include a cone configuration that enables a filter to be gripped at the smaller tapered end of the cone, allowing the filter to be incorporated into the fully formed cigarette. A backlight and/or transparent slot in the case can enable a user to observe the filling of the tube to ensure an adequate amount of material has been added to the cigarette during the grinding operation.

The cone can be segmented to allow the rolling of tubes and/or cigarettes of different lengths through the use of different sizes of planar material. A reusable holder element can be affixed to the end of the cone and incorporated into the finished tube or cigarette. The holder element may be formed of a suitable material such as glass, metal, plastic, etc. to provide a hygienic member that can be grasped by the user and contacted by the user's mouth during use. In some cases, the holder element can incorporate filter media within a central chamber such as activated charcoal or other material to provide filtering during use.

While the system as embodied in the aforedescribed embodiments is portable and manually activated by a user, other configurations are contemplated. An automated system can use the same or similar processing to form tubes and/or filled cigarettes. In some cases, the automated system can include a source of negative pressure (vacuum) to attach the planar material to the cone during rolling, and a source of positive pressure to apply a soft impulse of air to eject the finished tube from the end of the cone.

These and other features and advantages of various embodiments can be understood with a review of FIG. 1, which illustrates an isometric depiction of a portable cigarette roller and filler system 100. As explained below, the system 100 is configured as a portable device to enable a user to quickly and efficiently form a frusto-conically (tapered) tube of rolling material suitable for use as an outer casing for a cigarette style product (or for some other purpose). The system can further be used as desired to fill the tube with a smokeable material to form a completed cigarette.

Figure 2:
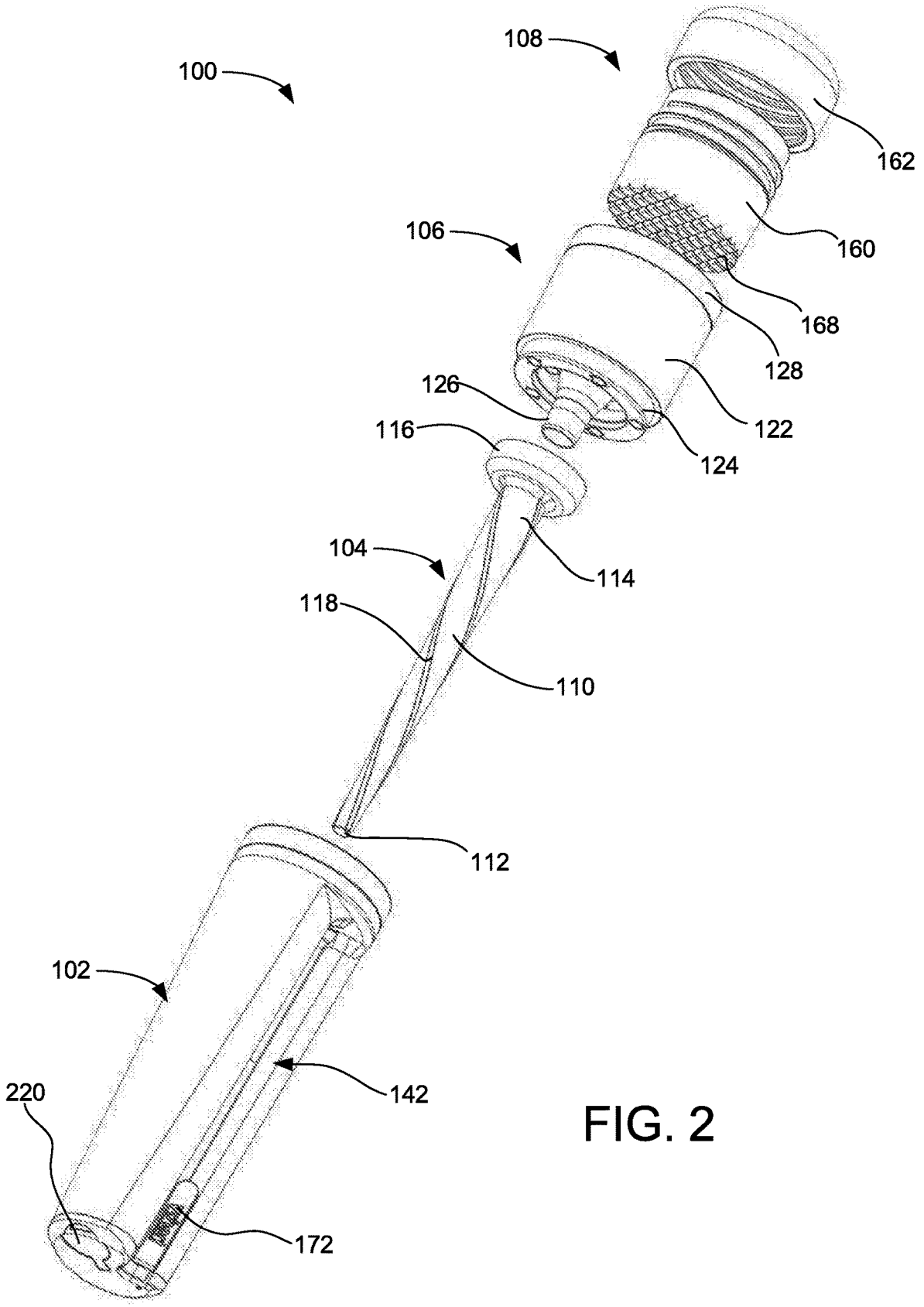
FIG. 2 is an exploded view of the system of FIG. 1.

FIG. 2 provides an exploded view of the system 100 of FIG. 1. As best viewed in FIG. 2, the system 100 includes a number of main components including a case (housing) 102, a removable cone 104, a body portion 106, and a grinder assembly 108. Each of these constituent elements will be described in detail below. It will be noted from FIG. 1 that the various elements interlock together to form an integrated portable unit that can be conveniently carried by a user. The elements can be formed of any suitable material, including but not limited to ABS (Acrylonitrile butadiene styrene) injection molded plastic.

The fully assembled system 100 as depicted in FIG. 1 has an overall substantially cylindrical, tapered shape with dimensions of about 7.5 inches (190 millimeters, mm) in length, and tapers from about 1.25 inches (32 mm) to about 2 inches (51 mm) in diameter. It will be appreciated that other sizes and configurations can be used, so these dimensions are merely for purposes of illustration and are in no wise limiting.

In some cases, different sizes and shapes can be provided for different systems to accommodate different sizes of finished tubes and cigarettes. Nevertheless, it is contemplated that the system is compact enough to enable a user to carry the system to a suitable location to form and smoke a manually rolled cigarette.

Figure 3A:
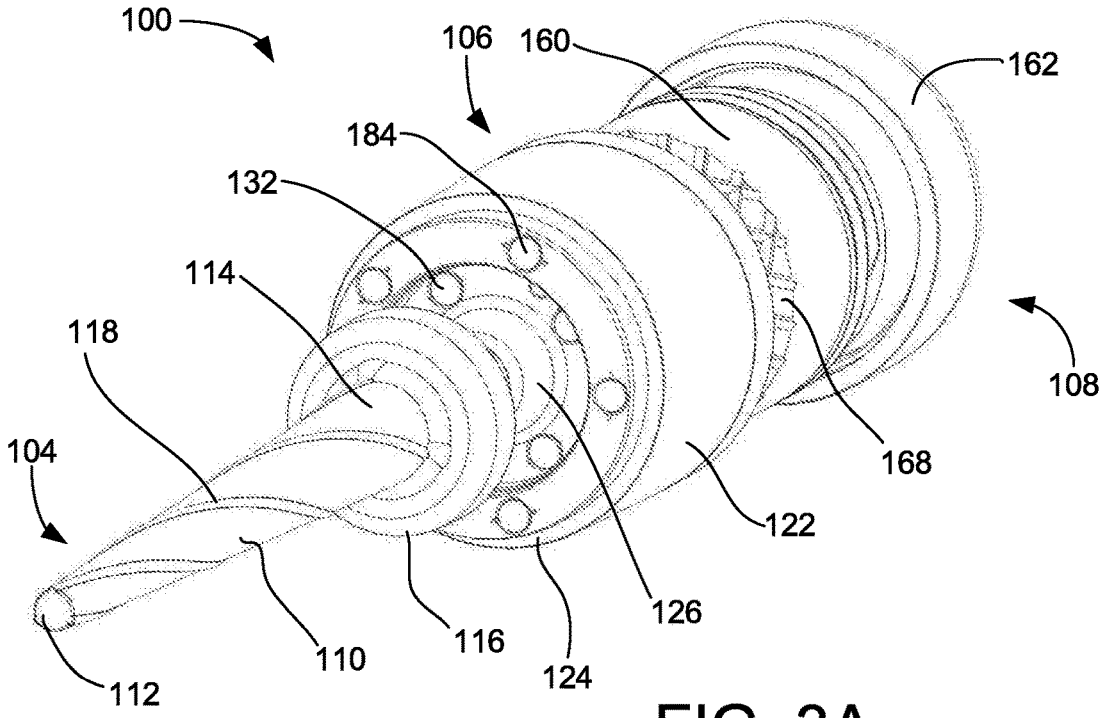
FIGS. 3A and 3B are isometric depictions of a cone and a body portion of the system in respective detached and attached configurations.
Figure 3B:
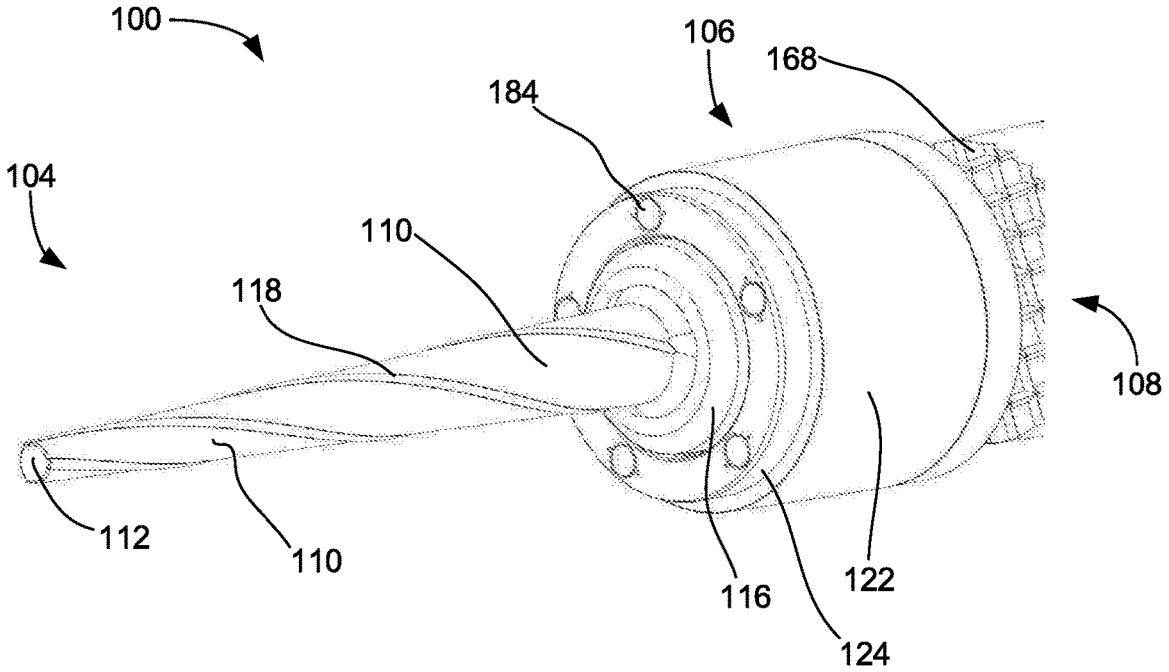
Figure 4A:
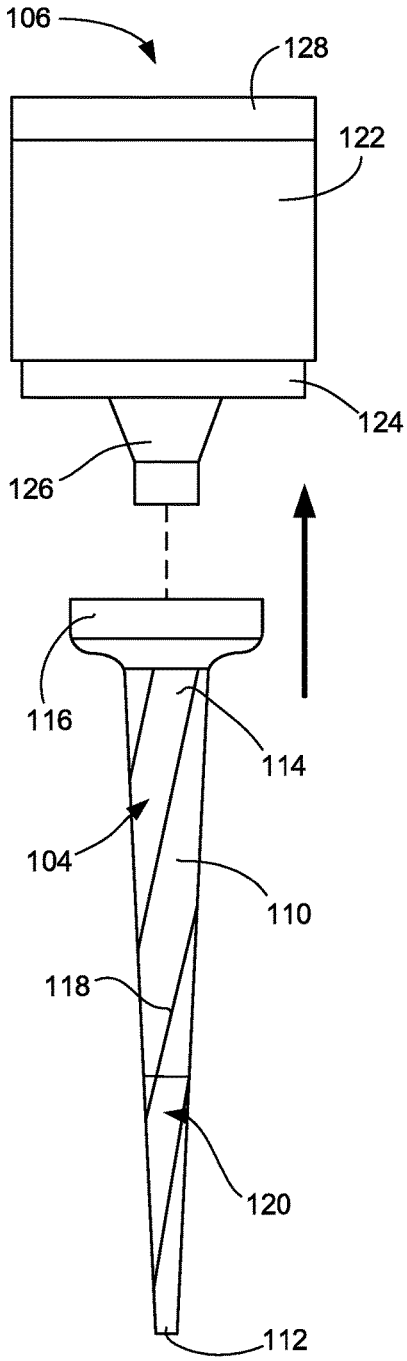
FIGS. 4A and 4B are side elevational schematic depictions of the respective configurations of FIGS. 3A and 3B.
Figure 4B:
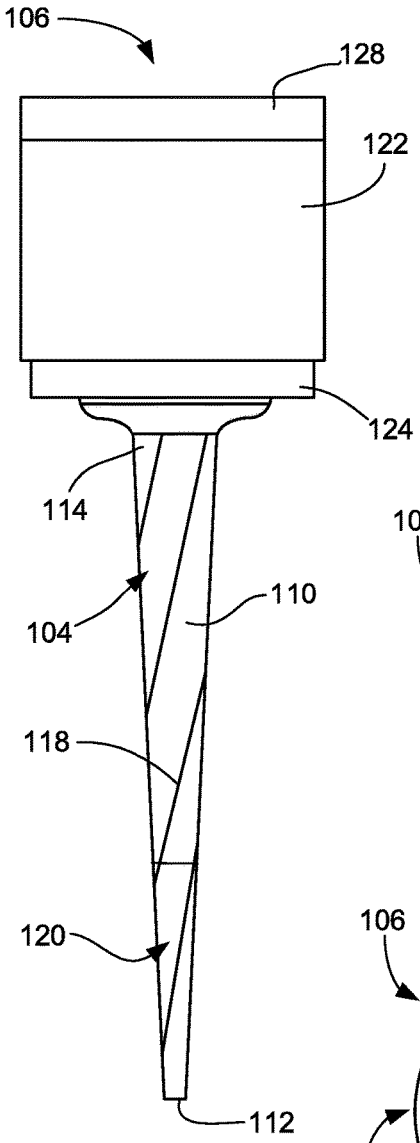

FIGS. 3A and 3B show respective isometric depictions of the cone 104 and body portion 106. FIGS. 4A and 4B provide corresponding schematic depictions of these elements. Initially, it will be noted that the cone 104 is adapted to be receivingly inserted into a central chamber (opening) within the case 102 during use. The cone 104, also sometimes referred to as a pin, has a frusto-conically shaped outer surface 110 that tapers at a selected angle, such as on the order of about 1-3 degrees along the length thereof, although other shapes and rates of taper can be used.

In some embodiments, the tapered outer surface 110 can extend from a distal, smaller end 112 having a diameter on the order of about 0.16 inches (4 millimeters, mm) to a proximal, larger end 114 having a diameter on the order of about 0.28 inches (7 mm). The length of the outer surface 110 is sized to accommodate suitable lengths of rolling material, such as but not limited to on the order of about 1.75 inches (34 mm). Other dimensions and rate of taper can be utilized as desired, so these values are merely exemplary and are not limiting.

An annular base 116 is affixed to the larger end 114 of the outer surface 110 of the cone 104. The cone 104 is hollow although such is not necessarily required. A gripping material 118 is affixed to the outer surface 110 as shown. The gripping material 118 can take any number of suitable forms, including rubber, thermoplastic elastomer (TPE), silicone, etc. In some embodiments, the gripping material 118 is formed as a sequence (such as three) of spaced-apart spirals that helically extend along the outer surface 110. While spirals are contemplated as particularly suitable, other arrangements can be used, including different numbers and arrangements of spirals, segments, discrete rings, pads, or other coated areas of gripping materials.

Without limitation, in further embodiments a fine coating of rubber, as generally depicted at region 120, can be applied to at least a distal end of the cone 104, as shown. The fine coating of rubber is incorporated as part of the gripping material. The gripping material enhances friction/attraction between the introduced planar material and the cone. The gripping material can be applied in any suitable manner to the underlying cone material. In some cases, the entire length of the cone can be uniformly coated with the fine coating of rubber.

The body portion 106, also sometimes referred to as a funnel body, is attachable to the annular base 116 of the cone 104, as depicted in FIGS. 3A-3B and 4A-4B. The funnel body 106 includes a hollow cylindrical portion 122, a recessed cylindrical shoulder portion 124, and a tapered projection 126. The tapered projection 126 is sized to fit within a hollow recess of the annular base 116 and proximal end 114 of the cone 104, as shown. A fine mesh screen 128 is attached to and covers an upper end of the funnel body 106. This arrangement provides an interior passageway that extends through the funnel body 106 from the screen 128 to the tapered projection 126.

Figure 5A:
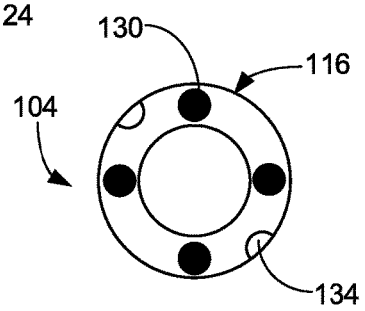
FIGS. 5A and 5B show mating surfaces of the cone and body portion that lockingly engage in some embodiments.
Figure 5B:
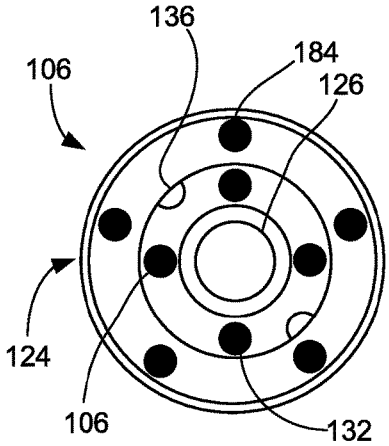

FIGS. 5A and 5B show the respective configurations of the cone 104 and the funnel body 106 at an interfacing junction between these elements. As shown in FIG. 5A, the annular body 116 of the cone 104 includes a series of spaced apart magnets 130. A total of four spaced apart magnets are provided, each at 90 degrees of separation about a central longitudinal axis of the cone 104. FIG. 5B shows a corresponding series of spaced apart magnets 132 recessed within the cylindrical shoulder portion 124 of the funnel body 106. The magnets 132 are also arranged at nominally 90 degrees of separation to matingly attract the magnets 130 of the cone 104.

Locking features are provided in the form of recesses 134 in the cone 104 and projecting detents 136 in the funnel body 106. These respective locking features rotationally secure the cone 104 to the funnel body 106 when these respective elements are attached using the respective magnets 130, 132. In this way, the application of rotational force to the cylindrical portion 122 of the funnel body 106 by the user induces corresponding rotation of the cone 104 within the central chamber of the case 102.

Figure 6:
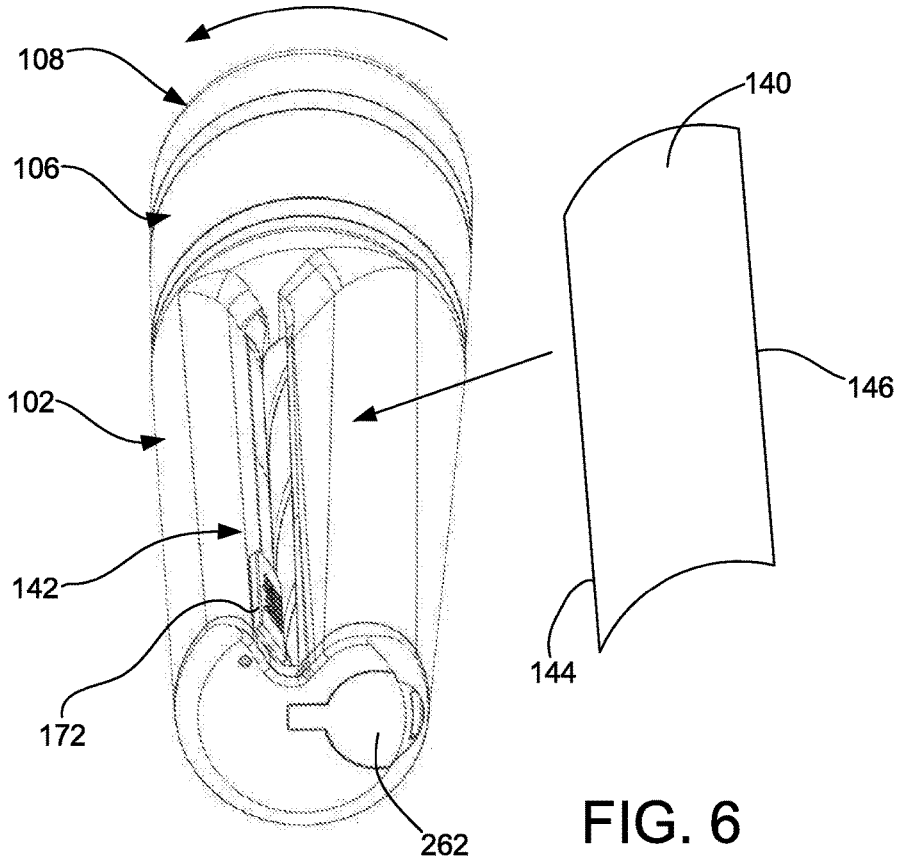
FIG. 6 is an isometric depiction of the system of FIG. 1 to generally illustrate the introduction of a planar material into a case (housing) of the system during a rolling operation.

FIG. 6 provides an isometric depiction of the system 100 of FIGS. 1-2 during a rolling operation. At this point, the cone 104 has been inserted into the central chamber of the case 102, and the funnel body 106 has been interlockingly mated to the cone 104 using the respective magnets 130, 132 and locking features 134, 136 of FIGS. 5A-5B. As desired, the grinding assembly 108 (FIGS. 1-2) has been attached to an upper end of the funnel body 106, although such is not necessarily required.

A piece of planar material 140 is inserted by the user into an elongated slot 142 of the case 102. The slot 142 extends along a length of the case, and is sized and oriented to facilitate presentation of a leading edge 144 of the planar material nominally parallel to a selected side of the tapered edge of the surface 110 of the embedded cone 104. Once inserted, the user grasps and rotates the funnel body 106, which causes the cone 104 to rotate. The material is advanced and wrapped around the cone 104 to form a tubular shape for the planar material.

As desired, the user can apply spittle (spit) by licking a distal end 146 of the planar material to ensure that the distal end adheres to the rest of the material and forms a fully formed tube. Other securement mechanisms can be used, including the use of adhesive along the distal end 146. The material can take any number of suitable forms, including rolling paper or blunt sheets (wraps). As will be recognized, rolling paper is usually formed of a paper material, while blunt sheets may be formed of any number of other suitable organic or synthetic wrappable materials (e.g., pressed tobacco, hemp, cannabis, other herbs, leaves, etc.).

Figure 7:
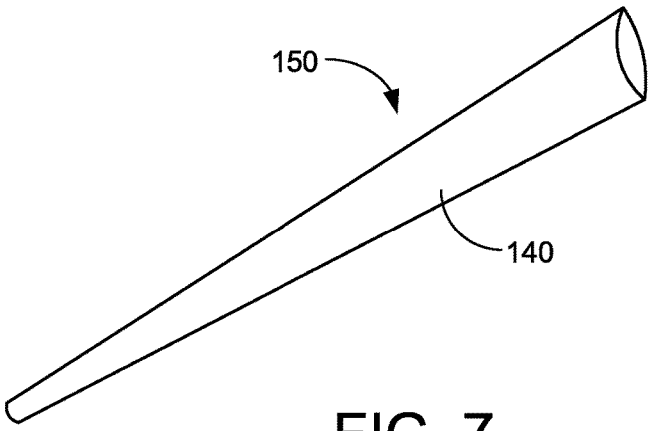
FIG. 7 depicts a finished tapered tube of the planar material at a conclusion of the rolling operation after extraction from the case.

A tube 150 generated by the rolling process is depicted generally in FIG. 7. The tube is an elongated, hollow, substantially tapered tube of planar material. It is contemplated that the tube 150 will be retained within the central chamber of the case 102, although at this point the tube can be extracted from the case by the user for further use in a variety of ways as desired.

Figure 8:
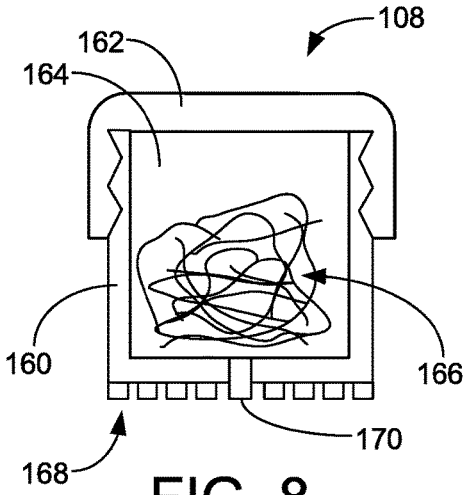
FIG. 8 is a cross-sectional representation of an interior storage chamber of a grinder assembly of the system to store smokable product.

FIG. 8 is a simplified cross-sectional depiction of the grinder assembly 108 of FIGS. 1-2. The grinder assembly 108 includes a cup-shaped main body 160 with a cap 162. The cap 162 is adapted to threadingly engage the main body 160 to form an enclosed product storage chamber 164. The storage chamber 164 is adapted to enclose and store a quantity of smokeable product, generally represented at 166. The smokeable product can take generally any suitable form, including cannabis, tobacco, herbs, or other suitable organic products.

A bottom surface of the body 160 includes grinding projections 168 suitable for crushing and grinding the product 166 once the product is poured into the top of the funnel body 106 against the fine mesh screen 128. A central magnet 170 provides a retention force to engage a corresponding magnet 171 (FIG. 9) located in a central portion of the screen 128 to retain the grinder assembly 108 to the funnel body 106.

During processing, once the tube 150 of planar material 140 has been formed within the case 102, the user detaches the funnel body 106, removes the cone 104, and reattaches the funnel body 106 to the case 102. This causes the tapered projection 126 (FIG. 4A) to extend into the topmost portion of the formed tube (FIG. 7).

The user removes the top cover 162 of the grinding assembly 108 and pours the product 166 from the interior chamber 164 into the top of the funnel body 106 against the screen 128. As desired, the user can reattach via threading engagement the top cover 162 onto the cup shaped main body 160. Thereafter, the user presses the grinder assembly 108 down onto the product 166 to crush and particulate the product against the screen 128.

Figure 9A:
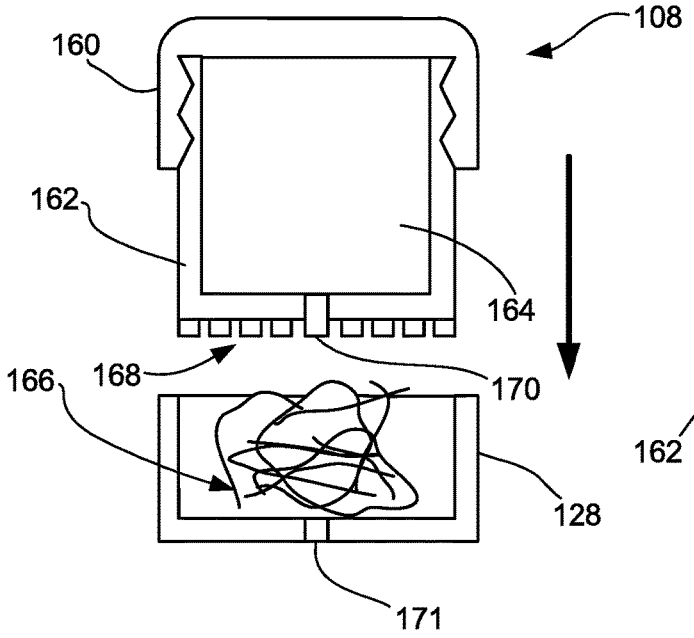
FIGS. 9A and 9B show a grinding operation using the grinding assembly of the system in some embodiments.
Figure 9B:
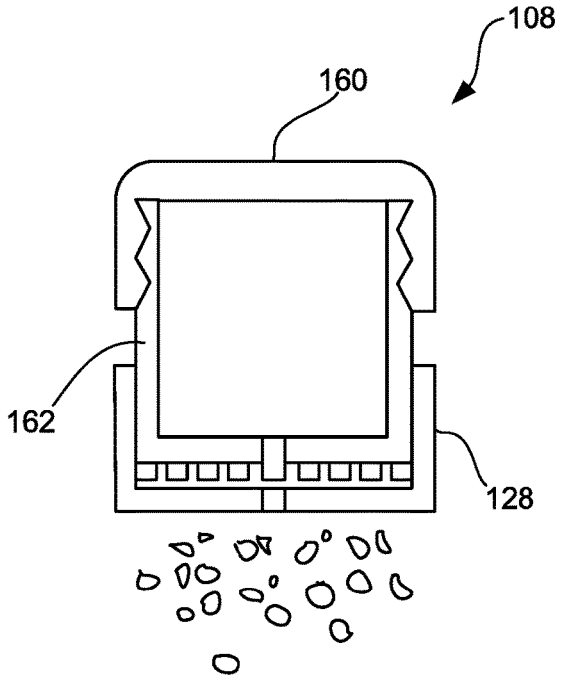
Figure 10A:
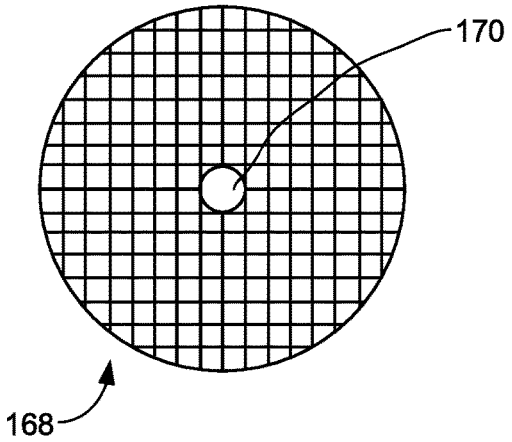
FIGS. 10A and 10B are facing end views of the grinding press and the mesh screen of the system in some embodiments.
Figure 10B:
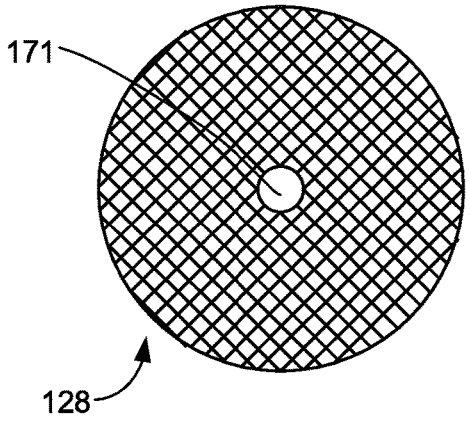

The pulverized product falls through the mesh screen and is directed through the funnel body into the tube to fill the cigarette, as generally represented in FIGS. 9A and 9B. The respective pairs of magnets 171, 172 retain the grinder assembly 108 on the funnel body 106 when not in use. For reference, FIGS. 10A and 10B provide planar schematic representations of the grinding surface 168 and the screen mesh 128, which operate as shown in FIGS. 9A and 9B to pulverize and pass the particulate material into the funnel body.

As noted above, the funnel body 106 directs the pulverized material down, via the tapered projection 126 (FIG. 4A), into the tapered tube (FIG. 7). Once sufficient product has been introduced into the cigarette, the user removes the funnel body 106 and the grinder assembly 108 from the case 102. The user activates a spring activated ejection lever 172 adjacent the distal end of the case (FIG. 6) to advance the cigarette from the case, enabling the user to remove the fully formed cigarette from the case for use.

Figure 11A:
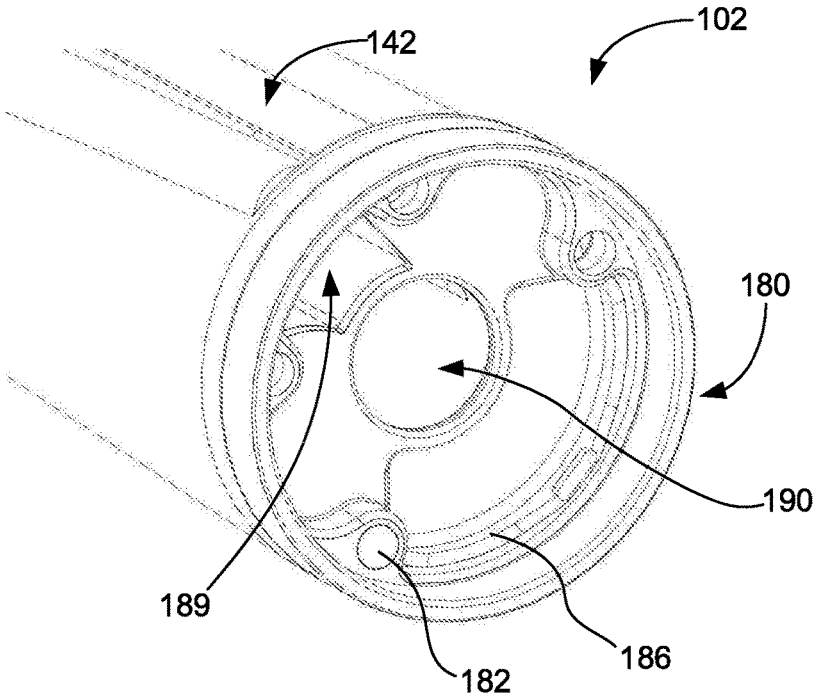
FIGS. 11A and 11B show a proximal end of the case to illustrate mating features (magnets) that selectively engage the mating surface of the body portion from FIG. 5B, as well as a storage rack that can be used to store a package of rolling material.
Figure 11B:
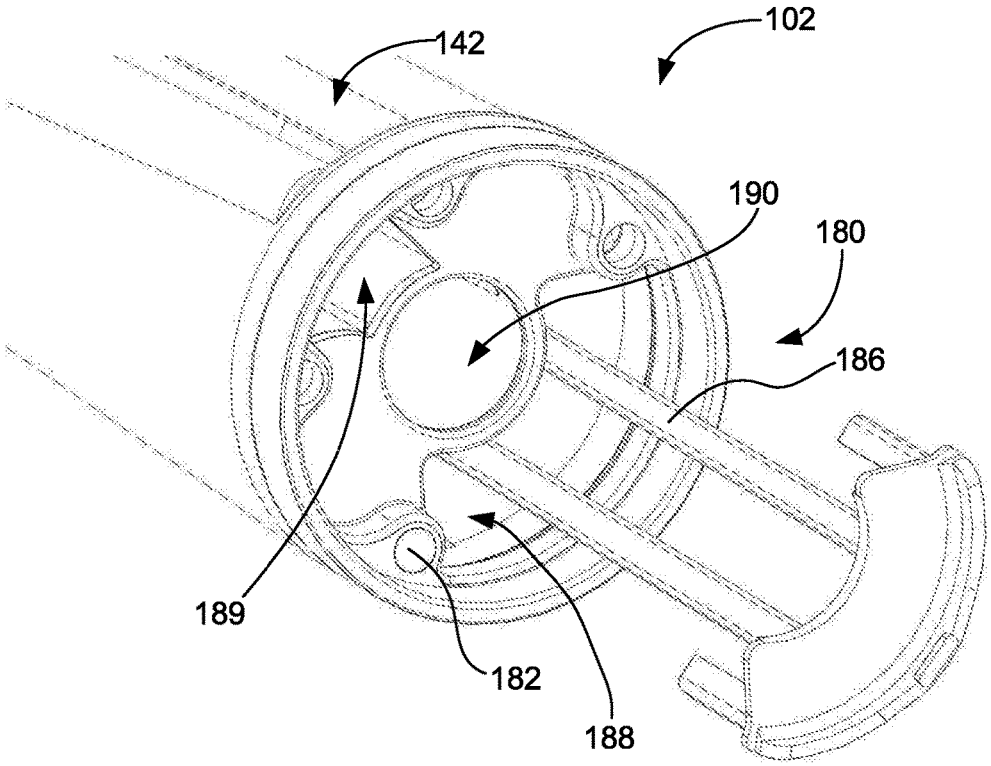

FIGS. 11A and 11B illustrate a proximal end 180 of the case 102 to depict further features of the system 100 in accordance with some embodiments. A series of magnets 182 are arranged in facing relation to the funnel body 106. In this case, a total of four magnets 182 are provided at approximately 72 degree increments. These magnets are configured to interact with five magnets 184 that project from the cylindrical shoulder portion 124 of the funnel body 106, as depicted in FIG. 5B. The magnets 184 in the funnel body 106 are also spaced apart at nominally 72 degree increments.

The magnet pairs 182, 184 enable the user to apply a selective ratcheting action as the funnel body 106 is rotated relative to the case 102 during the rolling operation. The user can be instructed to apply a selected number of interlocking turns as the magnets selectively engage and disengage as the planar material is rolled; for example, the user can be instructed to apply a total of five (5) "clicks" to ensure the planar material has been fully rolled about an entire circumference of the cone. Other numbers of clicks can be used to ensure that the rolling operation has been completed.

Only four (4) magnets 182 are shown in FIGS. 11A-11B, in order to accommodate an optional retractable storage rack 186. The storage rack 186 is sized to enable a package of the planar material sheets to be conveniently inserted and stored within an interior chamber 188 of the case, as shown. It will be appreciated that the storage rack can be omitted. It will further be appreciated that the case 102 can be provided with the same number (or a different number) of magnets to mate with the magnets of the funnel body.

Another optional opening is denoted at 189. This can be used for storage of other useful supplies, such as filters. Electronic equipment such as a vibrating element, battery, etc. can alternatively be located in this space as described below.

A central aperture of the case 102 is depicted at 190. The cone 104 is inserted into this central aperture 190 to commence the rolling operation, and it is from this central aperture that the fully formed tube/cigarette is subsequently ejected by lever mechanism 172 (FIG. 6).

Figure 12:
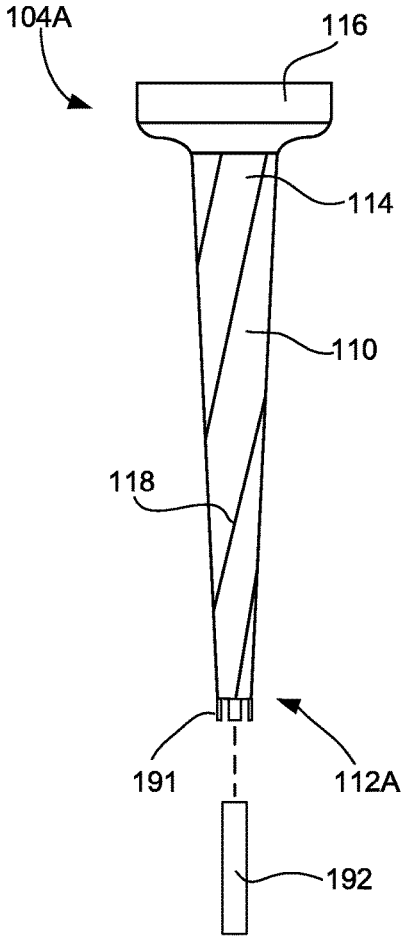
FIG. 12 shows an alternative configuration for the cone adapted to receive a filter prior to the rolling operation of FIG. 6.

FIG. 12 shows an alternative cone 104A that can be further used with the system 100 in accordance with some embodiments. The cone 104A is similar to the cone 104 described above, and like reference numerals have been used to identify similar features. One difference between the cone 104A and the cone 104 is that the cone 104A includes a specially configured distal end 112A with gripping features 191 that enable a filter 192 to be attached thereto. In this way, the rolled tube/cigarette can be equipped with an integrated filter. All other processing is carried out as described above.

Figure 13:
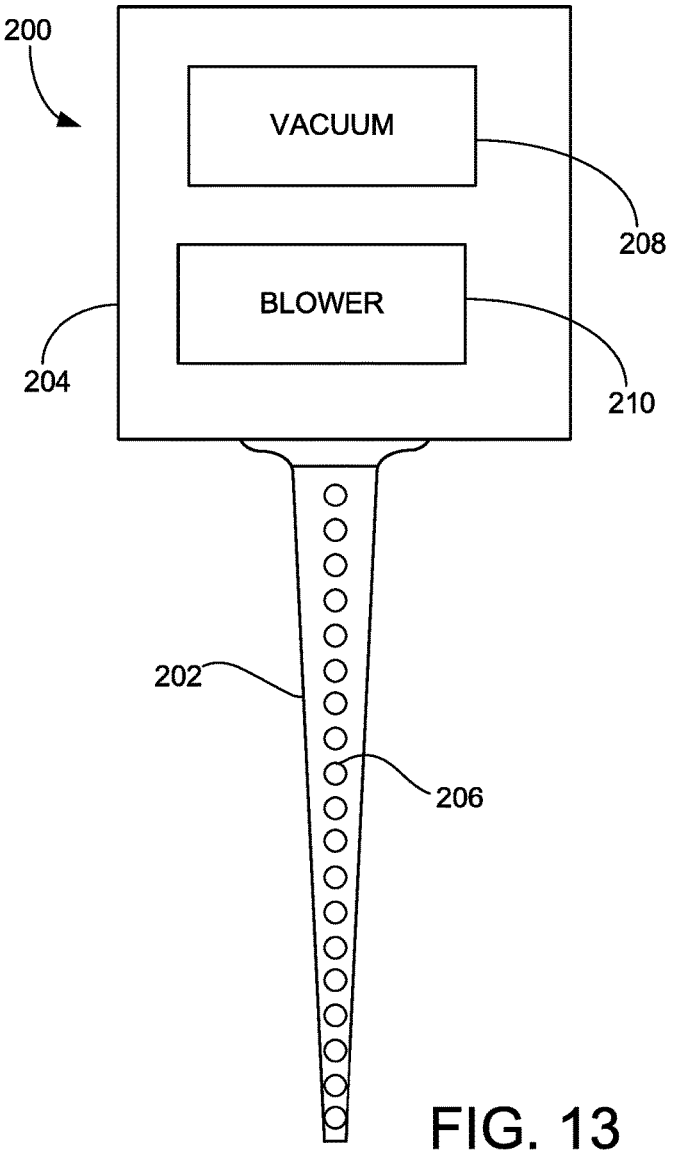
FIG. 13 illustrates another cone assembly configured for the automated generation of a quantity of tubes in a high volume manufacturing environment.

FIG. 13 shows another system 200 that can be utilized in accordance with various embodiments to form preformed tubes as discussed above in FIG. 7. The system 200 is configured to generate a population of nominally identical tubes in a high volume manufacturing environment. The cone 202 is attached to a main body 204, and includes an array of apertures 206 axially aligned as shown. The main body 204 may house a vacuum (source of low atmospheric pressure) 208 and a blower (source of high atmospheric pressure) 210.

During operation, a feeder system (not separately shown) can introduce sheets of planar material to the cone 202. The vacuum 208 applies a vacuum pressure via the apertures 206 to secure a leading edge of the planar material. An actuator (not separately shown) rotates the cone relative to the planar material to form a tube of material. An opposing end of the planar material is adhered to the previously rolled material, such as through the application of water, adhesive, etc. The view in FIG. 13 is a schematic drawing so different sizes, shapes, rates of taper, etc. can be utilized as required. While not required, gripping material, including but not limited to spirals, pads, coatings, and/or other arrangements of rubber, TPE, silicone or other suitable materials can be applied to portions of, or the entirety of, the outer surface of the cone 200 to enhance a gripping action between the cone and the wrapped material, as desired.

Figure 14:
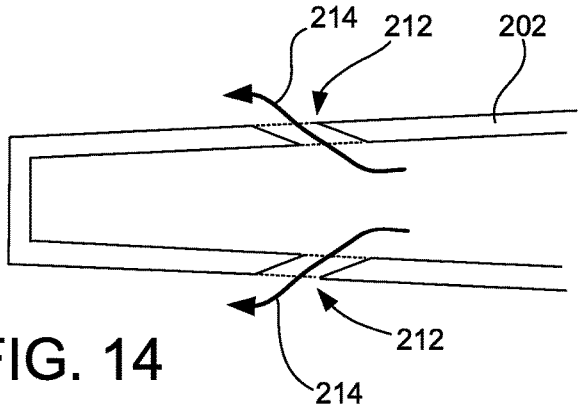
FIG. 14 shows aspects of another cone suitable for use in a high volume manufacturing environment.

As further shown in FIG. 14, ejection ports 212 can be formed in the cone 202. The ejection ports 212 are arranged to enable an impulse of positive pressure air, as depicted by arrows 214, to eject the formed tube of material from the cone 202. Separate flow lines are provided to respectively apply the negative and positive air flows to the respective ports to attract and eject the planar material. Different sizes, arrangements and numbers of the vacuum ports 206 and the ejection ports 212 can be used to initially secure the planar material to the cone 200, and subsequently blow the finished tubes off of the cone 200, as required.

Figure 15:
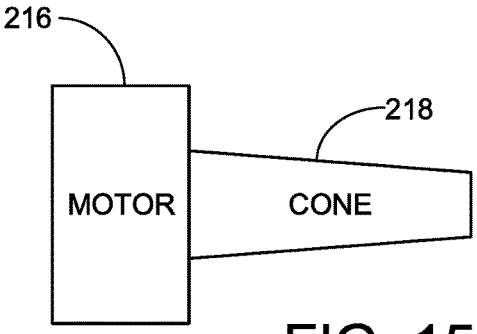
FIG. 15 is a schematic depiction of a motorized rolling system in further embodiments.

FIG. 15 is a schematic depiction of the foregoing systems 100, 200 in accordance with further embodiments in which an electric motor 216 is configured to rotate a cone 218. The cone 218 can correspond to any of the various cones described herein including the cones 104, 104A and 202. In this configuration, the motor 216 induces rotation of the cone 218 to form a suitable tube. Other operations, such as a grinding operation, can be carried out using a motor such as 216 as well.

Figure 16A:
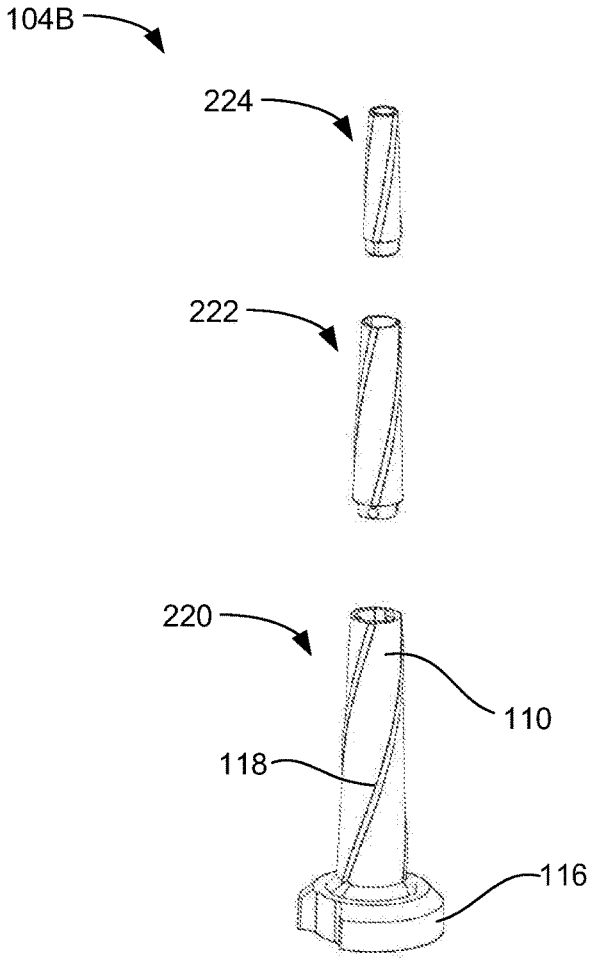
FIGS. 16A and 16B show the cone in accordance with further alternative embodiments.
Figure 16B:
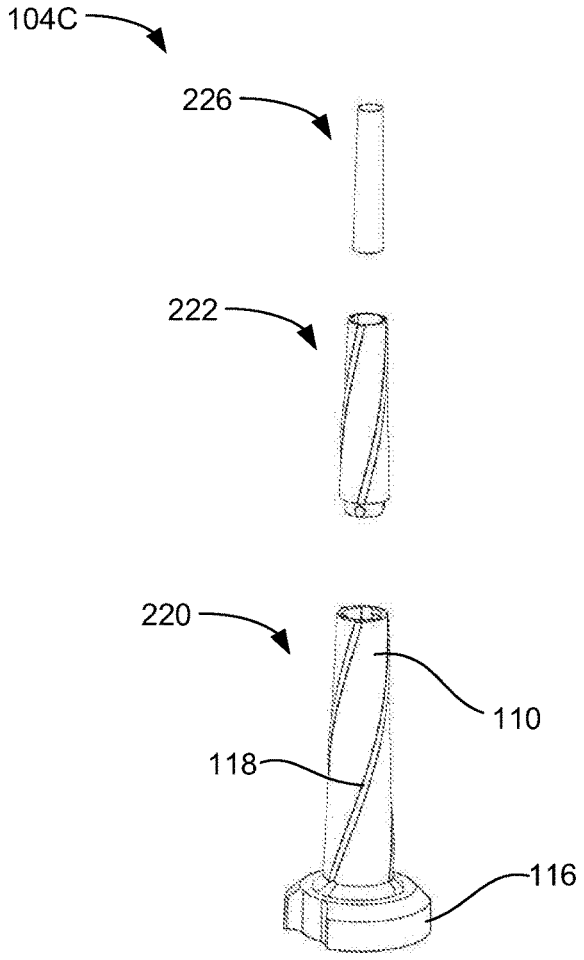

FIGS. 16A and 16B show further cone arrangements suitable for use with the foregoing embodiments. FIG. 16A shows a segmented cone 104B similar to the cone 104 in FIGS. 4A and 4B, with like reference numerals identifying similar features. The cone 104B is characterized as a segmented cone with a first (base) segment 220, a second (intermediate) segment 222 and a third (distal) segment 224. Each of the respective segments 220, 222 and 224 have outer surfaces with external gripping features as described above, and are removably attachable to one another using suitable locking mechanisms such as threads, detents, etc.

While three (3) segments are depicted, it will be understood that a larger or smaller number of segments can be used; for example, in an alternative arrangement, the first and second segments 220, 222 are integrated into a single unit and the third segment 224 is removably attachable to the end of the second segment 222. Other arrangements can be used.

FIG. 16B shows another segmented cone 104C. The cone 104C is similar to the cone 104B in FIG. 15A except that a holder element 226 is utilized instead of the third segment 224. The holder element 226 is a reusable member that engages the end of the intermediate (second) segment 222, allowing a distal portion of the planar material to be wrapped around at least a portion of the outer surface of the holder element. However, the holder element 226 remains integrated into the fully formed tube, rather than being retracted with other parts of the cone.

Figure 17:
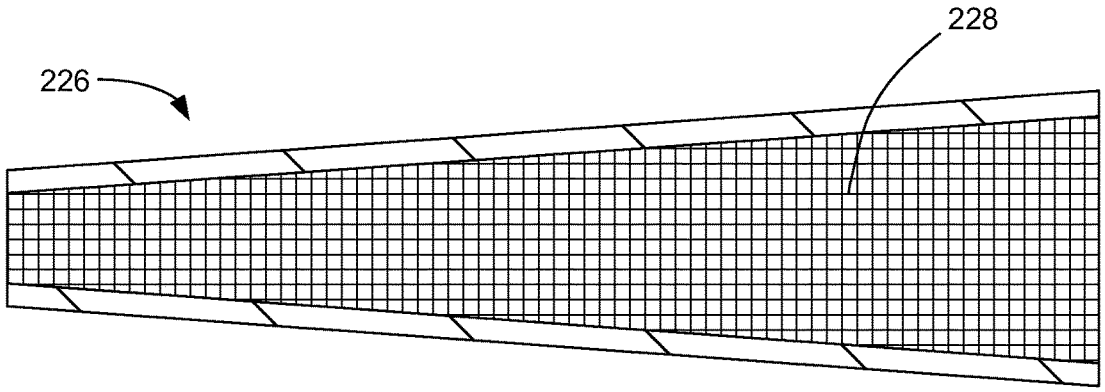
FIG. 17 is a cross-sectional depiction of a holder element that can be incorporated into the cone embodiment of FIG. 16B.

FIG. 17 shows the holder element 226 in greater detail. The holder element 226 is a hollow, frusto-conically shaped tube of durable and hygienic material to allow reuse. Other shapes and sizes, such as a cylindrical shape, can be used. The holder element 226 can be formed of glass, plastic, metal (e.g., stainless steel, etc.), or other suitable material(s). The holder element 226 maintains the tapered end of the tube/cigarette in an open configuration during smoking, and provides a rigid gripping surface for the user to hold the cigarette. As desired, filter media 228 can be removably inserted into the interior of the holder element 226 as shown. The filter media can be arranged as a separate filter as discussed above. Any and all kinds of possible filter media can be used, including but not limited to wood, paper, cardboard, glass, metal, bamboo, plastic, activated charcoal, cellofoam, fiber, etc.

Figure 18A:
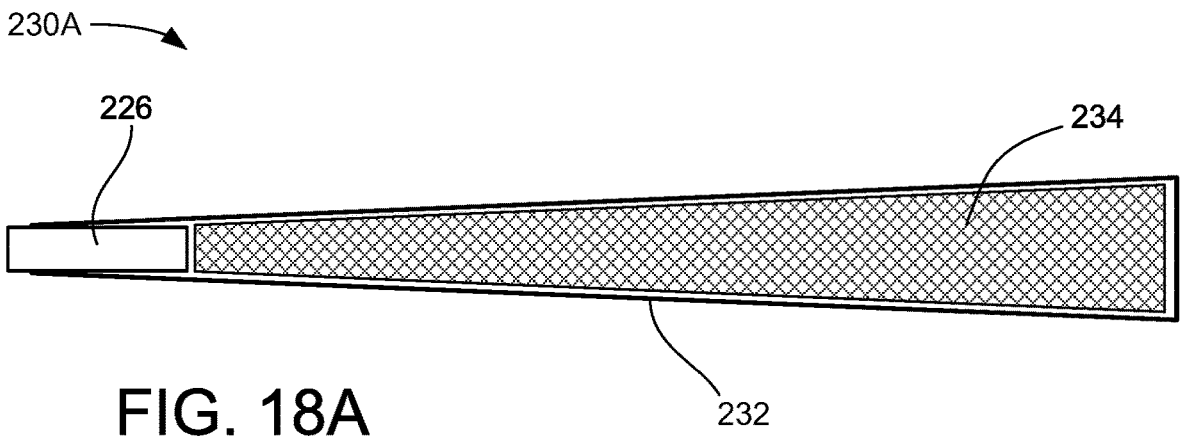
FIGS. 18A through 18C show cross-sectional representations of different configurations of cigarettes that can be formed using the cone configurations of FIGS. 16A and 16B.

The segmented cone arrangements of FIGS. 16A and 16B allow different forms of cigarettes to be formed by a user as desired. FIG. 18A shows a first cigarette 230A. The cigarette 230A is formed by wrapping a sheet of planar material 232 about the assembled cone 104C in 16B. The sheet of planar material may of the type sometimes referred to as a "king size" sheet, with nominal dimensions of about 36 mm (1.5 inches) in width by about 110 mm (4.3 inches) in length. This is merely for purposes of providing a concrete example and is not limiting, as any number of different shapes and sizes of planar material can be used as desired. Smokable material 234 (represented in cross-hatch) substantially fills the tube formed by the planar material as shown.

It will be noted from FIG. 18A that the holder element 226 is retained within the smaller end of the cigarette 230A. This can be accomplished by wrapping the planar material 232 about the cone 104C as described above, removing the cone and the material from the housing 102, gently pinching the planar material and the holder element, and retracting the first and second segments 220, 222 from the tube. This maintains the holder element within the tube, allowing both to be reinserted within the housing for introduction of the smokable material (product) 234. This provides a first overall amount (volume) of the smokable product within the cigarette 230A, along with a suitable holder/filter (element 226).

Figure 18B:
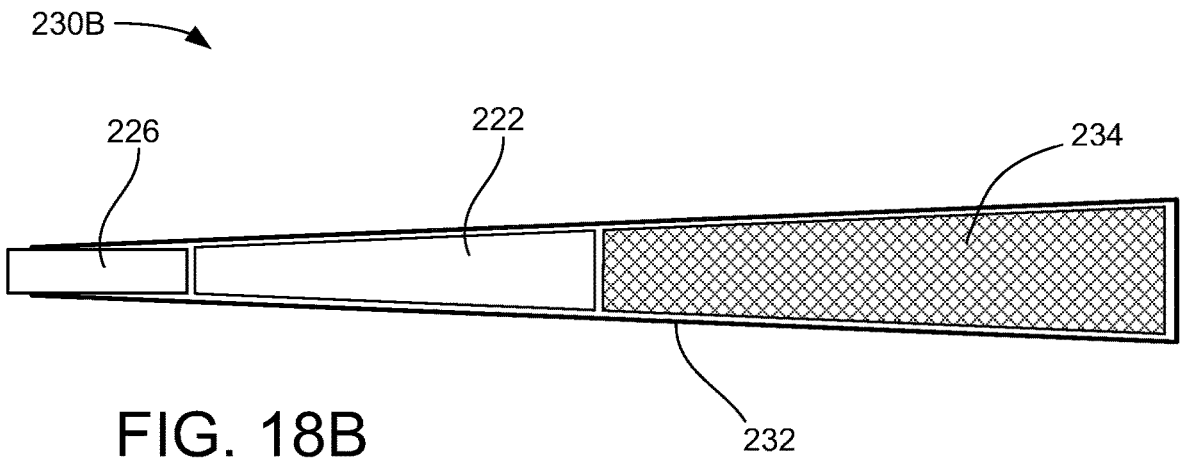

FIG. 18B shows another cigarette 230B. This cigarette is formed in a manner similar to the cigarette 230A in FIG. 18A, except that once the tube is rolled and retracted with the cone, the user gently pinches the middle part of the tube to secure and retain the second segment 222 (along with the element 226) within the tube while removing the first segment 220 from the tube. This may require twisting disconnection of the first element 220 from the second element 222 as the cone is removed from the tube.

As before, the tube is reinserted within the housing and filled with the smokable product 234. Because of the presence of the second segment 222, a smaller overall amount of the smokeable product 234 is provided within the finished cigarette 230B. It will be appreciated that in this embodiment, the second segment 222 should be formed of a suitable material that can survive being used in this fashion, such as the respective materials suggested above (e.g., metal, glass, etc.) for the holder element 226. Stated another way, the second segment 222 also operates as a holder element in this case.

Figure 18C:
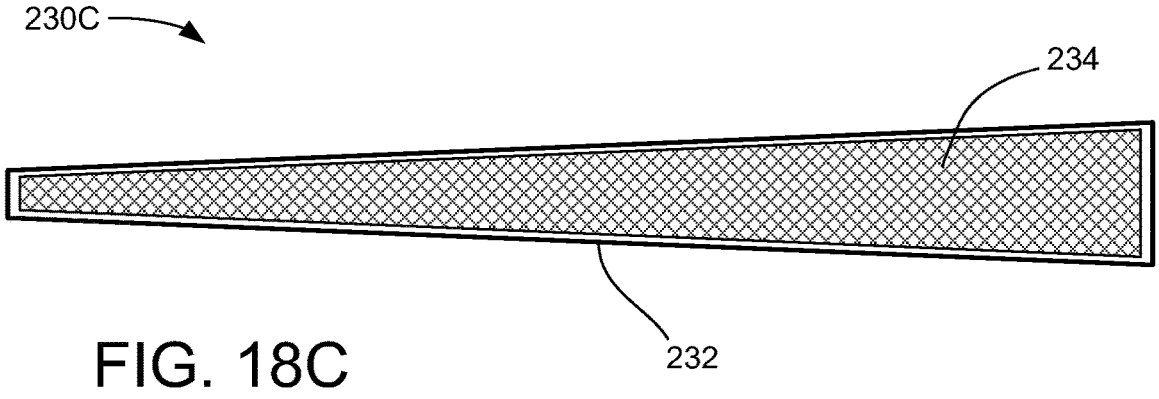

FIG. 18C shows yet another cigarette 230C. This cigarette is formed using the segmented cone 104B from FIG. 16A (or a non-segmented cone such as 104 in FIG. 4A, etc.). Once the planar material 232 is wrapped, the entire cone is removed, the tube is replaced within the housing and filled completely with the smokable product 234.

From these examples it can be seen that different combinations of the segments can be switched in and out to provide any number of desired cigarette configurations. While the foregoing examples have contemplated the use of king sized planar material (e.g., nominally 110 mm by 36 mm), the system can be readily adapted to accommodate other standard or non-standard sizes of planar material. These can include, without limitation, sizes referred to as "1¼ inch," "1½ inch," "single wide," "double wide," "84 mm," "king size slim," etc. The references to various sizes may relate to the width dimension (e.g., the circumferential distance around the cone 104B) or the length dimension (e.g., the axial length of the cone 104B). Commonly employed widths of the planar material can thus range from about 30 mm or less up to 36 mm or more, and lengths of the planar material can range from about 55 mm or less up to 110 mm or more. Other sizes can be used as desired, including standard or non-standard sizes greater or smaller than these ranges. In still further embodiments, a system can be supplied with a selection of differently sized cones and/or cone segments with various lengths, diameters and/or taper rates to allow substantially any size wrapping materials and fill amounts to be used.

Figure 19:
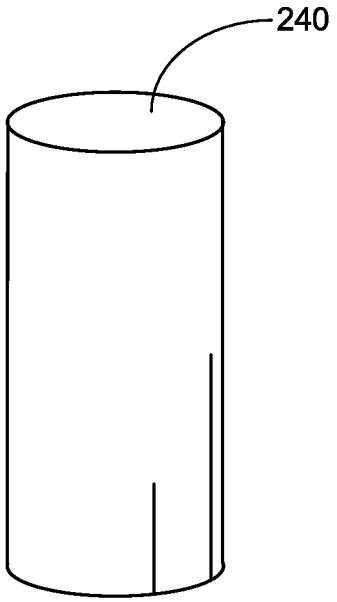
FIG. 19 depicts a vibrational element that can be incorporated into the system in accordance with further embodiments.

FIG. 19 depicts a vibrational element 240 that can further be incorporated into the foregoing systems. The vibrational element 240 is shown to have a substantially cylindrical configuration, although other shapes and sizes can be used. The element 240 may be energized by a source of motive power (such as electrical power) to oscillate (vibrate) at one or more selected amplitude(s) and frequency range(s). Any number of constructions can be utilized for the element including a piezoelectric transducer (PZT), an offset rotatable cam, etc. An advantage of the vibrational element 240 is that the vibrations can be used to advance and pack the smokeable material into a cigarette during the filling operation. This allows the unit to operate in substantially any desired orientation.

Figure 20:
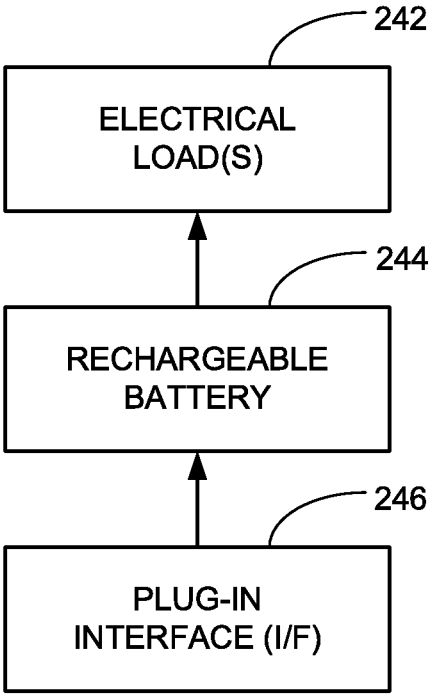
FIG. 20 is a functional block representation of electrical circuitry that can be incorporated into the system in accordance with further embodiments.

FIG. 20 is a functional block representation of electrical circuitry that can be incorporated into the various systems described above. The system includes one or more electrical loads 242, which can include the electric motor 216 (FIG. 15), the vibrational element 240 (FIG. 19), some other mechanism such as an electric grinder, etc. An energy storage source 244, such as a rechargeable battery, can be used to supply electrical power to the load(s) 242. A plug-in interface (I/F) module 246 can be used to connect a suitable power cord (e.g., mini-USB, etc.) to supply electrical power to charge the battery (or to drive the load(s) directly). While not limiting, the storage opening 189 discussed above in FIGS. 11A and 11B can be a suitable location for the vibrational element 240, the battery 244, the I/F 246, etc.

Figure 21:
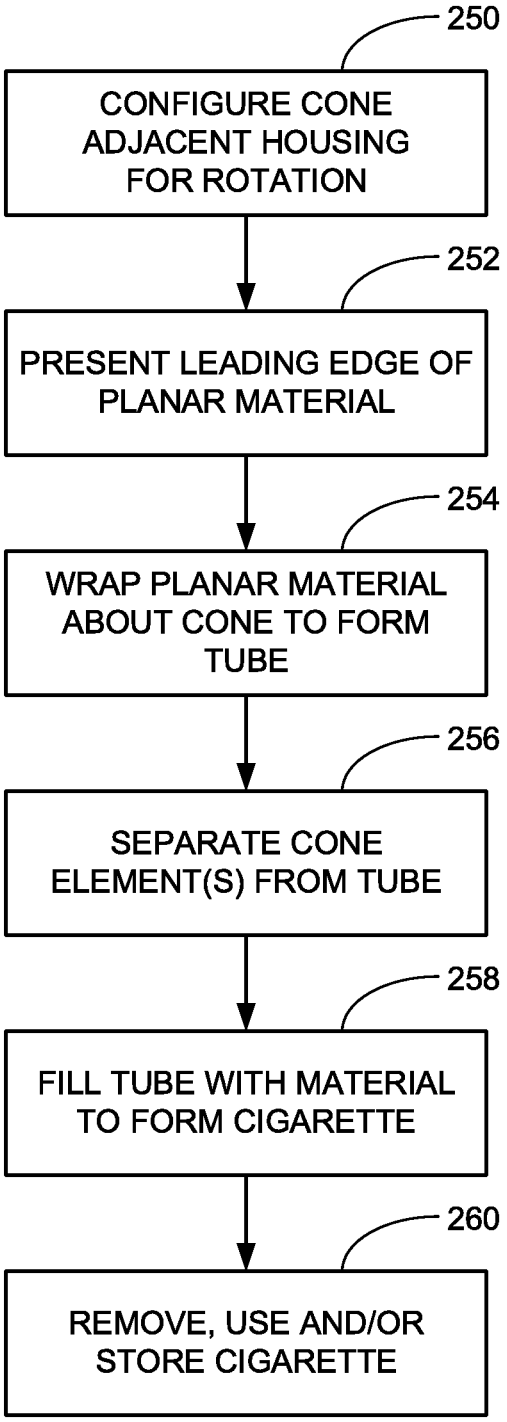
FIG. 21 is a flow chart to illustrate steps that can be carried out in accordance with some embodiments to form a tube and/or a fully formed cigarette.

FIG. 21 provides a flow chart for steps that can be carried out in accordance with the foregoing discussion to form a tube and, as desired, a fully formed cigarette. It will be appreciated that the various steps are merely exemplary and can be omitted, modified, performed in a different order, etc. depending on the requirements of a given application.

Step 250 commences with the provision of a rotatable cone adjacent an associated housing. The cone (pin) can take any suitable configuration including but not limited to the various cones 104, 104A-104C, 202 discussed above. The housing can similarly take any suitable form including but not limited to the case housing 102, the enclosure housing 204, etc. A suitable body portion of substantially any type is configured to enable the cone to be rotated with respect to the housing.

At step 252, a sheet of planar material is provided so that a leading edge of the material is aligned along the cone. As noted above, the planar material can take substantially any form of wrappable material that can be wrapped about the cone, which is carried out at step 254. This forms a hollow tube with a frusto-conical shape that nominally corresponds to the shape of the cone.

Once formed, the cone and the tube are separated at step 256. This may be carried out in some embodiments by retracting both the cone and the tube of planar material from the housing, followed by removing some or all of the cone from the interior of the tube. As noted in FIGS. 18A and 18B, other portions (e.g., one or more holder elements) may be retained within the tube. Once separated, the cone may be returned to a position within the housing.

In other embodiments, the cone and tube are separated such as discussed above in FIGS. 13-14, where negative pressure airflow can be used to initially secure the tube to the cone and positive pressure airflow can be used to subsequently eject the tube from the cone. In this latter case, the system can be used to separately generate cones that can be subsequently used in other processes to form cigarettes or other items.

Step 258 continues with the filling of the tube with smokable material to form a cigarette. This can be carried out as discussed above using the grinder and funnel body. This can be assisted with the use of vibrational input or other mechanisms as desired. The fully formed cigarette can thereafter be removed, used and/or stored as desired, step 260.

Other features can be incorporated into various embodiments as desired. Referring again to FIG. 6, a hinged cover 262 can be incorporated into the case 102. The cover 262 encloses another interior storage chamber within the case 102 to accommodate the storage of a preformed or partially smoked (and extinguished) cigarette formed by the system 100. Backlighting or other transparent mechanisms can be incorporated to enable a user to monitor and observe the rate at which the crushed product is introduced into the tube to achieve a desired fill amount. The planar material can be supplied in any suitable shape, including rectilinear as depicted in FIG. 6, trapezoidally shaped, curvilinearly shaped, etc.

It will now be appreciated that the various embodiments presented herein can provide a number of advantages over the existing art. The portable system provides a convenient and efficient mechanism for forming frusto-conically shaped tubes, which are particularly suitable for filling and smoking product. The system can further be used to conveniently and efficiently form fully rolled and filled cigarettes, and optionally includes various storage areas that can store papers/blunts, product, and a fully formed cigarette. Other embodiments provide efficient manual and automated mechanisms for forming tubes and cigarettes.

It is to be understood that even though numerous characteristics and advantages of various embodiments of the present disclosure have been set forth in the foregoing description, this description is illustrative only, and changes may be made in detail, especially in matters of structure and arrangements of parts within the principles of the present disclosure to the full extent indicated by the broad general meaning of the terms wherein the appended claims are expressed.

What is claimed is:

1. An apparatus, comprising:

a housing having a frusto-conically shaped outer surface that tapers from a larger first end to a smaller second end, the housing further having an interior chamber that extends into an interior of the housing from the larger first end and which is closed off at the smaller second end, the housing further having an elongated slot that extends through the housing from the larger first end to the smaller second end to provide open communication from the frusto-conically outer surface of the housing to the interior chamber;

a cone configured to be disposed within the interior chamber of the housing via insertion, by a user, of the cone through the larger first end of the housing, the cone having an annular base configured for placement adjacent the larger first end of the housing and a tapered portion configured to extend from the annular base into the interior chamber of the housing responsive to said insertion, the tapered portion having a frusto-conically shaped outer surface, the slot of the housing arranged with a sidewall that extends offset to and nominally parallel with a side of the frusto-conically shaped outer surface of the cone; and a body portion lockingly attachable to the annular base of the cone and rotatably coupled to the larger first end of the housing to induce rotation of the cone, via engagement by the user of a circumferentially extending outer surface of the body portion, with respect to and within the interior chamber of the housing to enable wrapping of a planar material about the cone to form a hollow tube having a frusto-conical shape responsive to insertion, by the user, of a leading edge of the planar material through the slot, wherein the body portion is characterized as a funnel body with a central passageway and a tapered projection in open communication with the central passageway, wherein the tapered projection extends into an interior recess of the cone when the body portion is lockingly attached to the annular base of the cone, the tapered projection extending through the annular base and into the tapered portion of the cone, and wherein the apparatus further comprises a grinder assembly configured to press organic material through a mesh screen to pass through the central passageway of the funnel body and into an interior hollow recess of the hollow tube to form a cigarette.

2. The apparatus of claim 1, wherein responsive to insertion of the cone into the housing through the larger first end, the housing circumferentially surrounds the tapered portion of the cone, a central longitudinal axis of the cone is aligned with a central longitudinal axis of the housing, and the sidewall of the slot is skewed with respect to the respective central longitudinal axes of the cone and of the housing.

3. The apparatus of claim 1, wherein the cone is configured to be removable from the tube while the tube is retained within the interior central chamber of the housing prior to the introduction of the organic material into the tube.

4. The apparatus of claim 1, wherein the grinder assembly comprises a press member configured to press the organic material through the mesh screen, the press member having an interior storage chamber configured to store the organic material therein prior to removal of the organic material from the interior storage chamber and placement of the organic material onto the mesh screen.

5. The apparatus of claim 1, further comprising a first storage area configured to store the organic material prior to grinding, a second storage area configured to store the planar material prior to a rolling operation, and a third storage area configured to store a completed cigarette.

6. The apparatus of claim 1, wherein the cone is characterized as a segmented cone having at least first and second segments which are removably attachable to each other to provide the cone with a desired length.

7. The apparatus of claim 1, further comprising a holder element affixed to a distal end of the tapered portion of the cone opposite the annular base, the holder element formed of a rigid material that is retained within the hollow tube after removal of the cone therefrom.

8. The apparatus of claim 7, wherein the holder element is characterized as a reusable member adapted for insertion into a mouth of the user during use of the tube as an outer casing of a cigarette, the reusable member formed of a non-combustible material to facilitate use in at least a second tube formed using the apparatus as an outer casing of a second cigarette.

9. The apparatus of claim 1, further comprising a vibrational element that operates to apply vibrations during a filling operation to fill the tube with smokable material.

10. The apparatus of claim 1, wherein the body portion is lockingly attachable to the annular base of the cone using a locking feature that interlocks the body portion to the annular base of the cone so that rotation of the body portion relative to the housing induces corresponding rotation of the cone about a cone axis within the housing, the locking feature comprising a detent that extends into a corresponding channel to prevent rotational movement of the body portion relative to the cone about the cone axis, the locking feature further comprising a pair of facing magnets with facing surfaces orthogonal to the cone axis that secure the body portion to the annular base to prevent movement of the body portion relative to the cone in a direction parallel to the cone axis.

11. The apparatus of claim 10, further comprising a first plurality of spaced apart magnetic elements in a first facing surface of the larger first end housing and a second plurality of spaced apart magnetic elements in a second facing surface of the body portion configured to secure the body portion to the housing and facilitate ratcheted rotation of the body portion relative to the housing during the rolling of the planar material into the hollow tube.

12. The apparatus of claim 1, wherein the body portion is rotatably coupled to the larger first end of the housing using a pair of facing magnets with facing surfaces orthogonal to a cone axis along which the tapered portion extends into the interior chamber, the pair of facing magnets configured to resist albeit permit rotational movement of the body portion relative to the larger first end of the housing while intermittently establishing an attraction force that retains the body portion to the housing in a direction parallel to the cone axis.

13. The apparatus of claim 1, wherein the tapered portion of the cone has a larger proximal end adjacent the annular base and a smaller distal end opposite the annular base, the distal end comprising at least one gripping member to secure a filter comprising filter media adjacent a distal end of the hollow tube.

14. The apparatus of claim 1, wherein the tapered portion of the cone has a larger proximal end adjacent the annular base and a smaller distal end opposite the annular base, and wherein the frusto-conically shaped outer surface of the tapered portion of the cone comprises a layer of gripping material configured to increase a surface friction between the planar material and the frusto-conically shaped outer surface of the tapered portion of the cone.

15. The apparatus of claim 14, wherein the layer of gripping material is arranged as at least one helically-shaped strip that circumferentially wraps about the tapered portion of the cone along an overall length thereof.

16. An apparatus for forming a manually rolled cigarette, comprising:

a curvilinearly extending housing having an elongated slot that extends through a sidewall of the housing from a frusto-conically shaped outer surface of the housing to a central interior chamber, the chamber open at a larger first end and closed at an opposing, second end of the housing;

a cone having an annular base and a tapered portion that extends from the annular base;

a funnel body with a cylindrically shaped outer surface that surrounds an interior passageway, a tapered projection configured for insertion into the annular base of the cone, and a locking mechanism that mechanically secures the funnel body to the annular base;

a first array of spaced apart magnets extending from the larger first end of the housing;

a second array of spaced apart magnets extending from the funnel body surrounding the tapered projection, the respective first and second arrays of spaced apart magnets configured to facilitate rotation, by a user, of the funnel body relative to the housing responsive to locking engagement of the cone to the funnel body and insertion of the tapered portion of the cone into the interior chamber of the housing along a central cone insertion axis, the slot having an interior slot sidewall skewed with respect to the central cone axis to facilitate wrapping of a planar sheet of material about the tapered portion to form a tube for the cigarette; and a manual grind press configured for insertion into the interior passageway of the funnel body to crush smokable product for passage into the tube after removal of the cone from the interior chamber of the housing, the manual grind press comprising a retention magnet that retains the manual grind press within the interior passageway of the funnel body when not in use.

17. The apparatus of claim 16, wherein the locking mechanism of the funnel body comprises a detent configured for insertion into a corresponding channel, the detent arranged on a selected one of the funnel body or the annular base of the cone and the channel arranged on a remaining one of the funnel body or the annular base of the cone and the channel, the locking mechanism of the funnel body further comprising a third array of spaced apart magnets arranged in facing relation to a corresponding fourth array of spaced apart magnets of the annular base of the cone.

18. The apparatus of claim 16, wherein the tapered portion comprises a helically extending strip of gripping material that wraps about the frusto-conically shaped outer surface of the tapered portion of the cone to enhance contact between the tapered portion and the layer of planar material.

19. An apparatus, comprising:

a housing having a frusto-conically shaped outer surface that tapers from a larger first end to a smaller second end, the housing further having an interior chamber that extends into an interior of the housing from the larger first end and which is closed off at the smaller second end, the housing further having an elongated slot that extends through the housing from the larger first end to the smaller second end to provide open communication from the frusto-conically outer surface of the housing to the interior chamber;

a cone configured to be disposed within the interior chamber of the housing via insertion, by a user, of the cone through the larger first end of the housing, the cone having an annular base configured for placement adjacent the larger first end of the housing and a tapered portion configured to extend from the annular base into the interior chamber of the housing responsive to said insertion, the tapered portion having a frusto-conically shaped outer surface, the slot of the housing arranged with a sidewall that extends offset to and nominally parallel with a side of the frusto-conically shaped outer surface of the cone; and a body portion lockingly attachable to the annular base of the cone and rotatably coupled to the larger first end of the housing to induce rotation of the cone, via engagement by the user of a circumferentially extending outer surface of the body portion, with respect to and within the interior chamber of the housing to enable wrapping of a planar material about the cone to form a hollow tube having a frusto-conical shape responsive to insertion, by the user, of a leading edge of the planar material through the slot, wherein the body portion is lockingly attachable to the annular base of the cone using a locking feature that interlocks the body portion to the annular base of the cone so that rotation of the body portion relative to the housing induces corresponding rotation of the cone about a cone axis within the housing, the locking feature comprising a detent that extends into a corresponding channel to prevent rotational movement of the body portion relative to the cone about the cone axis, the locking feature further comprising and a pair of facing magnets with facing surfaces orthogonal to the cone axis that secure the body portion to the annular base to prevent movement of the body portion relative to the cone in a direction parallel to the cone axis.

20. The apparatus of claim 19, further comprising a first plurality of spaced apart magnetic elements in a first facing surface of the larger first end housing and a second plurality of spaced apart magnetic elements in a second facing surface of the body portion configured to secure the body portion to the housing and facilitate ratcheted rotation of the body portion relative to the housing during the rolling of the planar material into the hollow tube.

21. An apparatus, comprising:

a housing having a frusto-conically shaped outer surface that tapers from a larger first end to a smaller second end, the housing further having an interior chamber that extends into an interior of the housing from the larger first end and which is closed off at the smaller second end, the housing further having an elongated slot that extends through the housing from the larger first end to the smaller second end to provide open communication from the frusto-conically outer surface of the housing to the interior chamber;

a cone configured to be disposed within the interior chamber of the housing via insertion, by a user, of the cone through the larger first end of the housing, the cone having an annular base configured for placement adjacent the larger first end of the housing and a tapered portion configured to extend from the annular base into the interior chamber of the housing responsive to said insertion, the tapered portion having a frusto-conically shaped outer surface, the slot of the housing arranged with a sidewall that extends offset to and nominally parallel with a side of the frusto-conically shaped outer surface of the cone; and a body portion lockingly attachable to the annular base of the cone and rotatably coupled to the larger first end of the housing to induce rotation of the cone, via engagement by the user of a circumferentially extending outer surface of the body portion, with respect to and within the interior chamber of the housing to enable wrapping of a planar material about the cone to form a hollow tube having a frusto-conical shape responsive to insertion, by the user, of a leading edge of the planar material through the slot, wherein the body portion is rotatably coupled to the larger first end of the housing using a pair of facing magnets with facing surfaces orthogonal to a cone axis along which the tapered portion extends into the interior chamber, the pair of facing magnets configured to resist albeit permit rotational movement of the body portion relative to the larger first end of the housing while intermittently establishing an attraction force that retains the body portion to the housing in a direction parallel to the cone axis.

* * * * *